United States Patent [19]

Gulko

[11] Patent Number: 4,576,580

[45] Date of Patent: Mar. 18, 1986

[54] PEDAL POWERED WATERCRAFT

[76] Inventor: Arnold G. Gulko, 1835 Arcola Ave., Silver Spring, Md. 20902

[21] Appl. No.: 639,313

[22] Filed: Aug. 10, 1984

[51] Int. Cl.[4] ..... B63H 16/12

[52] U.S. Cl. ..... 440/21; 440/26

[58] Field of Search ..... 114/58, 123, 162, 270; 440/9, 13-21, 22, 25-31, 90-94; 441/76

[56] References Cited

U.S. PATENT DOCUMENTS

| | | | |
|---|---|---|---|
| 1,761,883 | 6/1930 | Froedtert | 440/30 |
| 2,297,496 | 9/1942 | Pomilio | 440/17 |
| 2,520,804 | 8/1950 | Hollar | 440/9 |
| 2,937,612 | 5/1960 | Smith | 440/9 |
| 3,336,897 | 8/1967 | Jeney | 440/13 |
| 3,606,624 | 9/1971 | La Rocca et al. | 441/76 |
| 3,756,187 | 9/1973 | Livaudais | 440/20 |
| 4,285,674 | 8/1981 | Chew | 440/26 |
| 4,464,126 | 8/1984 | Maisonneuve | 440/15 |

*Primary Examiner*—Trygve M. Blix

*Assistant Examiner*—Stephen P. Avila

[57] ABSTRACT

A pedal powered watercraft is disclosed in which a centrally disposed longitudinally extending frame carries a centrally positioned pedal housing having one pedal on each side of said frame with one of a pair of longitudinally extending laterally horizontal boards mounted on each pedal. The frame carries a pair of vertically spaced apart stops constituted by horizontal bars extending outwardly from the frame on each side of the watercraft at the forward end of thereof. The boards extend forwardly of the pedals beyond the bars with these bars being positioned so that the upper bars are below the upper surface of the boards when the pedal carrying the same is at the upper limit of its path of movement, and the lower bars are above the lower surface of the boards when the pedal carrying the same is at the lower limit of its path of movement. This causes the forward end of both boards to point in such a direction that the tilt of both boards moves the craft forwardly when the upper board is depressed.

12 Claims, 3 Drawing Figures

PEDAL POWERED WATERCRAFT

TECHNICAL FIELD

This invention relates to watercraft which are powered by the user in the manner of a conventional bicycle.

BACKGROUND ART

Man has long desired to possess a simply structured watercraft which would allow him to use his weight and leg strength, as by a pedalling operation, to power the craft. Various devices, sometimes referred to as pedalogs, have been proposed, but these have various inadequacies. Some turn a screw propellor which usually provides little water-moving surface, and this is inefficient using the limited power available to a single person. Some rotate a large wheel, but these are bulky. It has not heretofore been possible to provide a simple and easily transportable structure which would allow limited foot movement to provide an extended powered path through the water.

DISCLOSURE OF INVENTION

In accordance with this invention, a pedal powered watercraft comprises a centrally disposed longitudinally extending frame carrying a centrally positioned pedal housing having one pedal movable from an uppermost to a lowermost position on each side of the frame, a pair of longitudinally extending laterally horizontal boards, one mounted on each pedal. These boards power the craft by coacting with a pair of vertically spaced apart stops which are conveniently in the form of horizontal bars carried by the frame to extend outwardly from the frame on each side of the watercraft at its forward end. These bars are positioned so that the upper bars are below the upper surface of the boards when the pedal carrying the same is at the upper limit of its path of movement, and the lower bars are above the lower surface of the boards when the pedal carrying the same is at the lower limit of its path of movement.

Before continuing the description, it is desired to use the limited description already presented to describe the powering of the craft through the water.

It will first be appreciated that a horizontal board immersed in water cannot simply move up and down in the water because the water will not easily move out of the way. As a result, if the immersed board has its front end depressed, it will move forwardly when pushed down, and it will move rearwardly when it is raised up. The board may be buoyant, in which case it will help to support the craft and its rider. As a result, and using two boards, one can place one's weight on one board to cause it to move downwardly in the water, while the other board is connected to the first by the pedals so that it will move upwardly. It follows that if both boards have the proper attitude, both boards can provide motion through the water in the same direction at the same time even though one points upwardly while the other points downwardly.

The proper attitude of both boards is maintained by the relative height of the boards, as positioned by the pedals, with respect to the forwardly positioned bars. When one pedal is at its highest point, the forward end of the board which is carried by that pedal must point downwardly because the upper bar limits its uppermost position. Correspondingly, with the first pedal at its highest point, the other pedal must be at its lowest point, and the forward end of the board carried by that pedal must point upwardly because the lower bar limits the lowermost position of that board.

Now that one can see how both boards are positioned when one of the pedals is at its highest point, it should be clear that if the rider places his weight on the pedal in the highest position, just as he would do when riding a bicycle, that the attached higher board will be forced down to move the boat forwardly while the other lower board is forced up because it is attached to the unpowered pedal which is driven along with the powered pedal to also move the boat forwardly. As the powered pedal now reaches its lowermost position in response to the weight of the rider, both boards engage the forward bars, and this pivots both boards to reverse their directions. As a result, when the rider shifts his weight onto the now uppermost board, the craft will continue to be powered in the same direction by both boards.

The boards will desirably provide a minor portion of the buoyancy needed for flotation of the craft and rider. The main flotation is provided by buoyant elements which are secured to the frame and positioned at the sides to provide dimensional stability as well as flotation. It will be understood that when the craft is moving through the water, that planing elements may be present to lift the craft in the water and reduce the resistance to motion. The rider can also wear buoyant devices, such as buoyant leg wrappings.

The boards are preferably mounted on the pedals at approximately the midpoint along the lengths of the boards. This provides balance for the craft. The rider will usually find it easier to pedal the craft if his feet are positioned slightly forward of the pedal position, and rubber elements may be mounted on the boards to help the rider position his feet and to help him maintain that position as the water flows past him. It will be appreciated that some propulsion is lost while the boards change their attitude (which occurs as the pedals move through their highest and lowest positions). It will also be observed that the tilt of the boards is slight, so a small vertical movement of the boards in the water corresponds to a much greater distance through the water, so the craft will move a great distance in comparison with the motion of the propelling boards, and appear to glide through the water. This is very like the action of a bicycle where a small motion of the pedals causes a much greater motion along the ground.

The pedals are pivotal supports, as is implicit in the term pedal, and they can be mounted for movement in unison, as in the normal bicycle, or independently. The circular pedal motion in a conventional bicycle can be accepted and is convenient because it is readily available, but is not necessary. A linear motion requires special construction, as will be illustrated, but it limits the forward and back motion of the boards and has other advantages, and is preferred where simplicity of construction is not in issue.

As will be evident, the frame desirably includes a forwardly positioned handle which operates a rudder for steering the craft, and a rearwardly positioned seat which the rider can use to rest upon or to sit upon while he pedals. The rider will usually stand to operate the pedals in order to maximize the use of his weight, but these aspects of the structure are no different herein than in a conventional bicycle.

A land bicycle has an action which balances it as it rolls along the ground, but that action is not fully available in this invention. Balance herein is fostered by the side floats which determine the water line in operation. These are preferably carried by the frame to extend longitudinally of the craft. When the craft tilts toward one side, the float on that side is forced into the water while the float on the other side is raised out of the water. Thus, any tendency of the craft to tip over is resisted by these sideward floats regardless of whether the craft is moving or not.

The bars are preferably connected at their outer extremities to keep them from being forced apart when they are engaged by the boards in operation, and also to prevent the boards from moving sideways away from the frame. Also, these bars can be surfaced with rollers to minimize friction with the boards as they are moved longitudinally with respect to the bars by the action of the pedals.

The frame includes the conventional handle bar which, in this invention, operates a rudder for steering the craft. This rudder is preferably connected directly to the handle bar and extends forwardly of the craft to keep it out of the way of the boards and to cause the craft to turn in the same way as a conventional bicycle. Also, this construction enables the rider, when the craft is relatively still in tight quarters, to turn the rudder from side to side and have it act as a small paddle to allow the craft to slowly back away from some obstruction.

The invention will be more fully described in conjunction with the accompanying drawings which shown an illustrative watercraft constructed in accordance with this invention.

Figure 1:
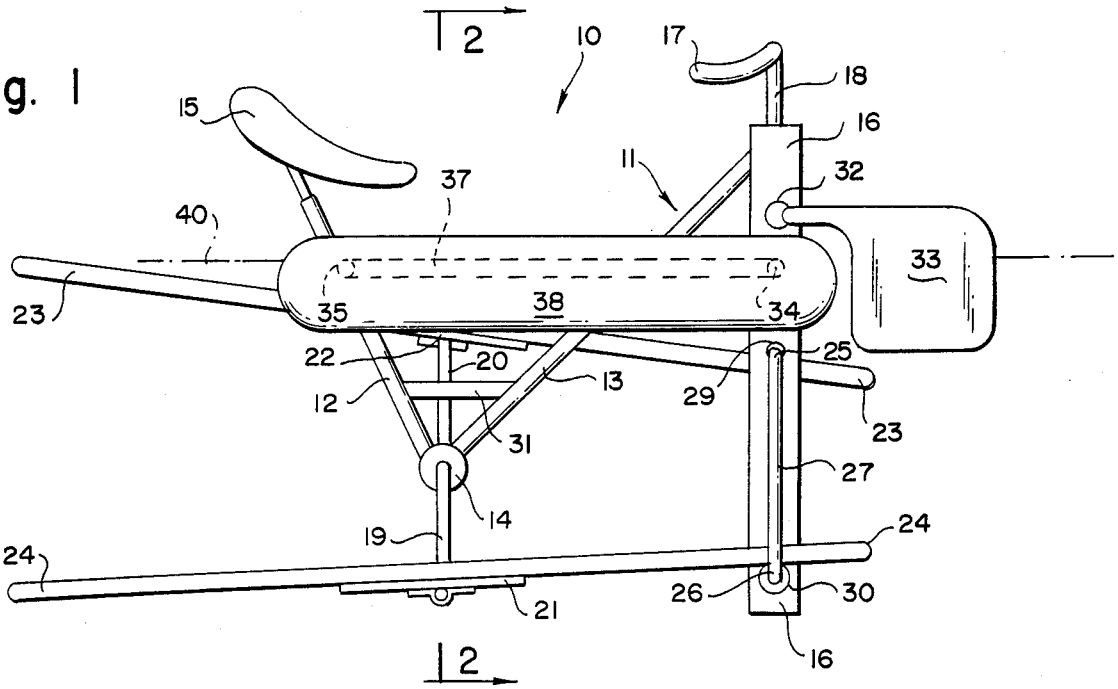
FIG. 1 is a side elevation of an illustrative watercraft, the expected water level being indicated by a phantom line.
Figure 2:
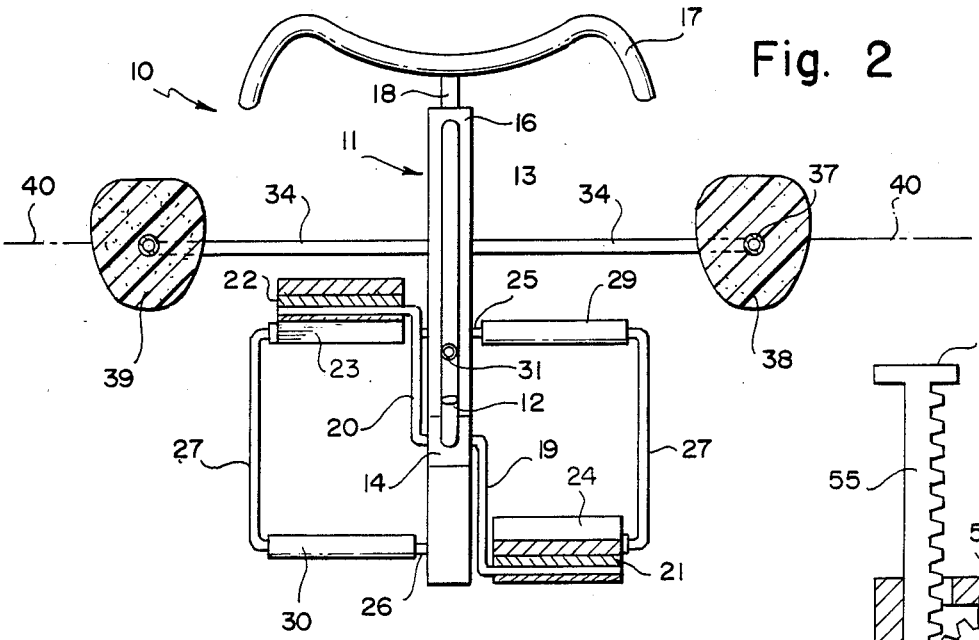
FIG. 2 is a cross-section taken on the line 2—2 of FIG. 1.

As can be seen in the drawing, the watercraft 10 includes a frame 11 which contains two joining supports 12 and 13 which carry pedal housing 14 where they join at the lower portion of the craft 10. The rear support 12 carries a seat 15 at its upper end, and the forward support 13 is welded to a vertical tubular support element 16 which carries handle bar 17 at the upper end of a rod 18 which extends into the tubular support 16.

The pedal construction is conventional except that no sprocket is needed. Pedal rods 19 and 20 are interconnected in normal fashion so that one pedal 21 and the other pedal 22 extend outwardly on opposite sides of the frame 11. As will be evident, the pedals are rotatably mounted in ordinary fashion, but they are larger than usual because they have to support the boards 23 and 24. The connection can be a permanent one, as with an appropriate adhesive, but easy transportability suggests that the boards should be bolted to the pedals, such connection not requiring any showing, except that the bolts will be countersunk to be out of the way. Also, one may optionally provide foot sockets on the boards, but this is not essential and is not shown.

The craft would normally be the size of a conventional bicycle with the boards being about 8 to 10 inches wide and about $\frac{1}{2}$ to $\frac{3}{4}$ inch thick. While buoyant boards of various type can be used, it is presently preferred to use marine plywood which is coated to seal the same after it has been cut to size. Using a bicycle frame of normal adult size, these boards would be about 4 to 6 feet in length.

The vertical tubular support 16 extends downwardly below the pedal housing 14 and vertically spaced upper and lower horizontal bars 25 and 26 extend outwardly from support 16 on both sides of the frame 11. These are positioned as previously described and as pictured so that the boards 23 and 24 will have their forward ends pointed correctly when the pedals hold these boards in their uppermost and lowermost positions pictured in the drawing. To insure that the forward ends of the boards will not ride out away from the frame 11, the outer ends of the bars 25 and 26 are joined by a connecting bar 27, but this is not essential since one can rely upon the securement between the boards and the pedals.

As will be evident, near the top and bottom of the pedal motion, the boards will rub against the bars 25 and 26, and this friction can be tolerated, or reduced by covering these bars with tubular rollers 29 and 30.

Returning to the handle bar 17, its supporting shaft extends into the tubular support 16 which is slotted at 32 to accomodate rudder 33. When the handle bar is turned, the rudder turns with it, and when the craft is moving, its forward end will move in the direction indicated by the handle bars, so the steering action is the same as in a bicycle.

Supports 12 and 13 can be braced at 31. Supports 16 and 12 carry sidewardly extending bars 34 and 35 which carry a float support 37 to which is secured side floats 38 and 39, one at each side of the craft. These floats can be constituted by polystyrene foam elements which are strapped to the float support, but since any desired attachment is satisfactory, this aspect of the structure is not shown. The side floats and the weight of the rider determine the water line 40 when the craft is at rest.

Figure 3:
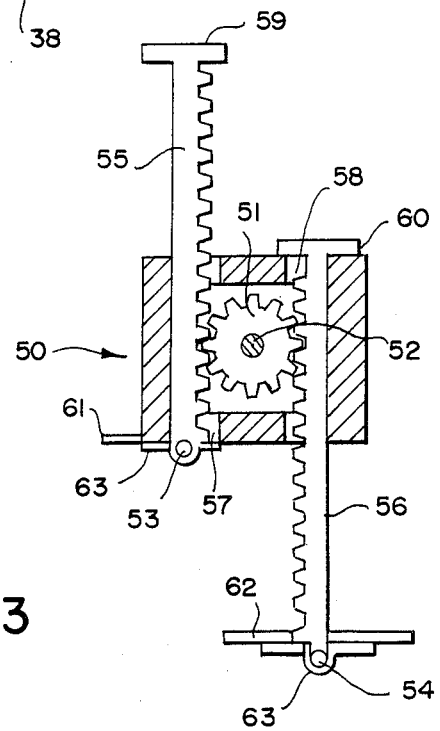
FIG. 3 is a cross-section through an alternative pedal housing which enables a linear pedal motion to limit the longitudinal movement of the boards with respect to the watercraft.

A preferred pedal mounting is shown in FIG. 3 where it will be seen that pedal housing 50 carries a pinion 51 on shaft 52 and the pedal shafts 53 and 54 are supported at the lower ends of toothed racks 55 and 56 which extend vertically through the housing 50 in contact with opposite sides of pinion 51 via vertical slots 57 and 58. Stops 59 and 60 at the upper ends of the racks limit the downward motion of each of these racks. The boards are not shown, but these are secured to plates 61 and 62 which are pivoted to the pedal shafts 53 and 54 by simple U-shaped brackets, as indicated at 63. As will be evident, the housing 50 would be closed by a cover plate which is not shown.

In operation, when one places ones weight on the board supported by pedal plate 62, it will be forced into its lowermost position, and this, via pinion 51, elevates the board supported by pedal plate 61.

What is claimed is:

1. A pedal powered watercraft comprising a centrally disposed longitudinally extending frame carrying a centrally positioned pedal housing having one pedal movable from an uppermost to a lowermost position on each side of said frame, a pair of longitudinally extending laterally horizontal boards, one mounted on each of said pedals, said frame carrying a pair of vertically spaced apart stops positioned outwardly of said frame on each side of the watercraft at the forward end thereof, said boards extending forwardly of said pedals beyond said stops with said stops being positioned so that the upper stops are below the upper surface of said boards when the pedal carrying the same is at the upper limit of its path of movement, and the lower stops are above the lower surface of said boards when the pedal carrying the same is at the lower limit of its path of movement.

2. A pedal powered watercraft as recited in claim 1 in which said stops are constituted by upper and lower horizontal bars which are secured to one another at their sideward extremity.

3. A pedal powered watercraft as recited in claim 1 in which said boards are mounted on said pedals at approximately the midpoint along the lengths of the boards.

4. A pedal powered watercraft as recited in claim 1 in which the frame includes a forwardly positioned handle which operates a rudder for steering the craft, and a rearwardly positioned seat.

5. A pedal powered watercraft as recited in claim 4 in which said rudder is connected directly to said handle and extends forwardly of the craft to avoid said boards and to cause the craft to turn in the same way as a conventional bicycle.

6. A pedal powered watercraft as recited in claim 1 in which longitudinally extending side floats are provided to determine the water line.

7. A pedal powered watercraft as recited in claim 6 in which said floats are carried by said frame.

8. A pedal powered watercraft as recited in claim 2 in which said bars are surfaced with rollers to minimize friction with said boards as they are moved longitudinally with respect to the bars by the action of the pedals.

9. A pedal powered watercraft as recited in claim 1 in which said boards are made of plywood.

10. A pedal powered watercraft as recited in claim 1 in which said pedals are mounted for circular motion.

11. A pedal powered watercraft as recited in claim 1 in which said pedals are mounted for linear motion.

12. A pedal powered watercraft as recited in claim 11 in which said pedals are mounted at the lower ends of racks which are interconnected by means of a pinion.

* * * * *